US008465598B2

(12) United States Patent
Katsumata

(10) Patent No.: US 8,465,598 B2
(45) Date of Patent: Jun. 18, 2013

(54) VACUUM CARBURIZATION PROCESSING METHOD AND VACUUM CARBURIZATION PROCESSING APPARATUS

(75) Inventor: Kazuhiko Katsumata, Saitama (JP)

(73) Assignee: IHI Corporation (JP)

( * ) Notice: Subject to any disclaimer, the term of this patent is extended or adjusted under 35 U.S.C. 154(b) by 714 days.

(21) Appl. No.: 11/861,012

(22) Filed: Sep. 25, 2007

(65) Prior Publication Data

US 2008/0073001 A1 Mar. 27, 2008

(30) Foreign Application Priority Data

Sep. 27, 2006 (JP) ..... 2006-262525

(51) Int. Cl.

| | |
|---|---|
| ***C23C 8/20*** | (2006.01) |
| *C23C 8/22* | (2006.01) |
| *C23C 8/30* | (2006.01) |
| *C23C 8/32* | (2006.01) |
| *C23C 8/00* | (2006.01) |

(52) U.S. Cl.
USPC ..... 148/223; 148/206; 266/250

(58) Field of Classification Search
USPC ..... 148/223, 206; 266/250
See application file for complete search history.

(56) References Cited

U.S. PATENT DOCUMENTS

| | | | |
|---|---|---|---|
| 3,796,615 A | 3/1974 | Westeren et al. | 148/16.5 |
| 4,191,598 A | 3/1980 | Conybear et al. | 148/16.5 |
| 4,386,973 A | 6/1983 | Kawka et al. | |
| 4,950,334 A | 8/1990 | Nishioka et al. | 148/16.5 |
| 5,702,540 A | 12/1997 | Kubota | 148/223 |

(Continued)

FOREIGN PATENT DOCUMENTS

| | | |
|---|---|---|
| CN | 1394982 | 2/2003 |
| CN | 1549871 | 11/2004 |

(Continued)

OTHER PUBLICATIONS

Japanese Office Action dated Jul. 7, 2009 (with English translation).

(Continued)

*Primary Examiner* — Keith Walker
*Assistant Examiner* — Alexander Polyansky
(74) *Attorney, Agent, or Firm* — Ostrolenk Faber LLP

(57) ABSTRACT

A vacuum carburization processing method includes a preparatory heating step of increasing the temperature of a workpiece in a heating chamber to a first temperature, a carburizing step of carburizing the workpiece by supplying carburizing gas into the heating chamber from a state where the pressure inside the heating chamber is reduced to an extremely low pressure, a diffusing step of terminating the supply of the carburizing gas and making carbon diffuse from a surface of the workpiece into its internal part, and a quenching step of abruptly cooling the temperature of the workpiece from a state where the temperature of the workpiece is at a second temperature; and also includes, between the diffusing step and the quenching step, a normalizing step of reducing the temperature of the workpiece so that the temperature history of the workpiece from the first temperature to a predetermined temperature satisfies predetermined conditions, a post-normalization maintaining step, performed after the normalizing step, of miniaturizing crystal grains of the workpiece by maintaining the workpiece at the predetermined temperature for a predetermined time so that the entire workpiece reaches the predetermined temperature, and a reheating step, performed after the post-normalization maintaining step, of increasing the temperature of the workpiece to the second temperature.

4 Claims, 10 Drawing Sheets

U.S. PATENT DOCUMENTS

| | | | | |
|---|---|---|---|---|
| 6,913,449 | B2 | 7/2005 | Loeser et al. | 417/423.15 |
| 2002/0024166 | A1 | 2/2002 | Fukada et al. | 264/123 |
| 2004/0187966 | A1 * | 9/2004 | Yamaguchi et al. | 148/223 |
| 2007/0194504 | A1 * | 8/2007 | Nakashima et al. | 266/104 |

FOREIGN PATENT DOCUMENTS

| | | | |
|---|---|---|---|
| CN | 1813163 | A | 8/2006 |
| DE | 10243179 | A1 | 4/2004 |
| EP | 0 723 034 | A2 | 7/1996 |
| JP | 48-14538 | | 2/1973 |
| JP | 55-28391 | | 2/1980 |
| JP | 61-117268 | | 6/1986 |
| JP | A-02-122062 | | 5/1990 |
| JP | 04-173917 | | 6/1992 |
| JP | 05-025554 | | 2/1993 |
| JP | 5-279836 | | 10/1993 |
| JP | 06-010037 | | 1/1994 |
| JP | 06-100942 | | 4/1994 |
| JP | 06-172960 | | 6/1994 |
| JP | 8-325701 | | 12/1996 |
| JP | 09-263930 | | 10/1997 |
| JP | 11-036060 | | 2/1999 |
| JP | 11-118357 | | 4/1999 |
| JP | 2000-129418 | | 5/2000 |
| JP | 2001-98343 | | 4/2001 |
| JP | 2001-240954 | | 9/2001 |
| JP | 2001-272019 | | 10/2001 |
| JP | 2004-115893 | | 4/2004 |
| WO | WO 03/048405 | A1 | 6/2003 |

OTHER PUBLICATIONS

European Search Report dated Feb. 16, 2010 issued in corresponding European Patent No. 1905862 (7 pages).

An Office Action issued on Dec. 2, 2008 on counterpart Japanese Patent Application No. 2006-262525, with English translation (4 pages).

English translation of an Office Action, issued by the State Intellectual Property Office, P.R. China, on the counterpart Chinese Patent Application No. 200810083406.5, dated Sep. 4, 2009 (8 pages).

Office Action dated Jun. 21, 2011 issued in corresponding U.S. Appl. No. 12/043,470.

Office Action dated Apr. 24, 2012 issued in corresponding Chinese Patent Application No. 201110062321.0 with-English translation (18 pages).

Office Action dated Aug. 29, 2012 issued in corresponding U.S. Appl. No. 13/402,636.

Notice of Allowance dated Oct. 10, 2012 in corresponding Chinese Patent Application No. 201010537562.1 (with English language translation).

* cited by examiner

VACUUM CARBURIZATION PROCESSING METHOD AND VACUUM CARBURIZATION PROCESSING APPARATUS

BACKGROUND OF THE INVENTION

1. Field of the Invention

The present invention relates to a vacuum carburization processing method and a vacuum carburization processing apparatus.

Priority is claimed on Japanese Patent Application No. 2006-262525, filed Sep. 27, 2006, the content of which is incorporated herein by reference.

2. Description of Related Art

Vacuum carburization process is one process of carburizing the surface layer of a metal workpiece and quenching it in order to increase its hardness. Patent Document 1 (Japanese Unexamined Patent Application, First Publication No. Hei 8-325701) and Patent Document 2 (Japanese Unexamined Patent Application, First Publication No. 2004-115893) are examples of vacuum carburization processes.

The vacuum carburization process of Patent Document 1 heats the workpiece to a predetermined temperature in a heating chamber at extremely low pressure, and carburizes the workpiece by applying a carburizing gas such as acetylene into the heating chamber. The supply of carburizing gas is stopped and the heating chamber is returned to a state of extremely low pressure, whereby carbon near the surface of the workpiece is diffused into it; after reducing the temperature to a quenching temperature, the workpiece is cooled with oil.

The vacuum carburization process of Patent Document 2 solves a problem of excessive carburization of the surface (particularly the corners) of the workpiece by supplying a decarburizing gas into a furnace (identical to the heating chamber of Patent Document 1) during initial diffusion in a vacuum carburization process such as that of Patent Document 1, thereby reducing or removing cementite on the surface of the workpiece.

In conventional vacuum carburization processes such as those mentioned above, carburization and diffusion proceed more rapidly at higher processing temperatures. Accordingly, the higher the processing temperature, the shorter the time required by the vacuum carburization process. On the other hand, when the vacuum carburization process is performed at high temperature, the crystal grains of the workpiece become enlarged. There is a problem in which the workpiece of which the crystal grains is enlarged does not have predetermined physical values.

SUMMARY OF THE INVENTION

The present invention has been realized in view of these circumstances. It is an object of the invention to solve the problem of enlargement of the crystal grains of a workpiece caused by high temperature processing, even when the processing time is shortened by increasing the processing temperature in order to accelerate carburization and diffusion, and obtain a workpiece having predetermined physical values.

To achieve these objects, a vacuum carburization processing method of the invention includes a preparatory heating step of increasing the temperature of a workpiece in a heating chamber to a first temperature, a carburizing step of carburizing the workpiece by supplying carburizing gas into the heating chamber from a state where the pressure inside the heating chamber is reduced to an extremely low pressure, a diffusing step of terminating the supply of the carburizing gas and making carbon diffuse from a surface of the workpiece into its internal part, and a quenching step of abruptly cooling the temperature of the workpiece from a state where the temperature of the workpiece is at a second temperature; the method also includes, between the diffusing step and the quenching step, a normalizing step of reducing the temperature of the workpiece so that the temperature history of the workpiece from the first temperature to a predetermined temperature satisfies predetermined conditions, a post-normalization maintaining step, performed after the normalizing step, of miniaturizing crystal grains of the workpiece by maintaining the workpiece at the predetermined temperature for a predetermined time so that the entire workpiece reaches the predetermined temperature, and a reheating step, performed after the post-normalization maintaining step, of increasing the temperature of the workpiece to the second temperature.

In another arrangement of the vacuum carburization processing method according to the invention, the carburizing step, the diffusing step, the normalizing step, and the reheating step are performed inside the heating chamber.

In another arrangement, the quenching step is performed in a cooling chamber that is provided separately from the heating chamber and cools the workpiece.

In yet another arrangement, the preparatory heating step, the diffusing step, and the reheating step are performed in a state where the pressure inside the heating chamber is reduced to an extremely low pressure, or a state where an inactive gas is introduced into the heating chamber.

A vacuum carburization processing apparatus according to the invention includes a heating chamber including a heater, and a cooling chamber including a cooler, the apparatus using the heater to increase the temperature of a workpiece in the heating chamber to a first temperature, carburizing the workpiece by supplying carburizing gas into the heating chamber from a state where the pressure inside the heating chamber is reduced to not more than a predetermined pressure, terminating the supply of the carburizing gas and making carbon diffuse from a surface of the workpiece into its internal part, and using the cooler to abruptly cool the temperature of the workpiece in the cooling chamber from a state where the temperature of the heating chamber is at a second temperature. The second cooler is provided inside the heating chamber, and reduces the temperature of the workpiece after carburization so that the temperature history of the workpiece from the first temperature to a predetermined temperature satisfies predetermined conditions; crystal grains of the workpiece are miniaturized by maintaining the workpiece at the predetermined temperature for a predetermined time so that the entire workpiece reaches the predetermined temperature.

In another arrangement of the vacuum carburization processing apparatus according to the invention, the second cooler cools the workpiece by circulating air inside the heating chamber.

In another arrangement of the vacuum carburization processing apparatus, the heater includes a heat-generating member that is arranged inside the heating chamber and is made from a conductive material capable of withstanding abrupt cooling from a high temperature state, and a supporting member that is attached to an outer wall of the heating chamber and supports the heat-generating member in a secure position with respect to the outer wall of the heating chamber. Current measuring means for measuring the earth fault current of the heat-generating member is provided outside the heating chamber, an earth fault of the heat-generating member being detected from a measurement taken by the current measuring means.

In another arrangement, the cooler cools the workpiece by circulating high pressure gas.

In yet another arrangement, the heater includes a gas convection apparatus.

Another aspect of the vacuum carburization processing apparatus according to the invention includes a heating chamber including a heater and a cooler. The apparatus uses the heater to increase the temperature of a workpiece in the heating chamber to a first temperature, carburizes the workpiece by supplying carburizing gas into the heating chamber from a state where the pressure inside the heating chamber is reduced to not more than a predetermined pressure, terminates the supply of the carburizing gas and makes carbon diffuse from a surface of the workpiece into its internal part, and uses the cooler to abruptly cool the temperature of the workpiece from a state where its temperature is at a second temperature. The cooler reduces the temperature of the workpiece after carburization so that the temperature history of the workpiece from the first temperature to a predetermined temperature satisfies predetermined conditions. Crystal grains of the workpiece are miniaturized by maintaining the workpiece at the predetermined temperature for a predetermined time so that the entire workpiece reaches the predetermined temperature.

According to the vacuum carburization processing method of the invention, since normalization and temperature-maintenance are performed in that order after diffusion, even if the crystal grains of the workpiece become enlarged during carburization and diffusion at high temperature in order to shorten the processing time, the crystal grains of the workpiece can be miniaturized by normalization followed by temperature-maintenance. In particular, the temperature distribution of the entire workpiece can be made uniform by normalization followed by temperature-maintenance, and the crystal grains of the workpiece can be reliably and uniformly miniaturized. Therefore, the processing time can be shortened by processing at a high temperature while also solving the problem of crystal grain enlargement caused by high-temperature processing. This makes it possible to obtain a workpiece having predetermined physical values, and to reliably achieve a desired product quality.

Moreover, according to the invention, since reheating and quenching are performed after normalizing, the vacuum carburization process can be completed efficiently.

According to the vacuum carburization processing apparatus of the invention, since the heating chamber includes a cooler, it is easy to execute normalization followed by temperature-maintenance after diffusion. In particular, since a heater is required for temperature-maintenance, cooling and heating must be performed continuously in order to perform normalization followed by temperature-maintenance. This can easily be achieved by providing the heating chamber with a cooler. Since providing the heating chamber with a cooler also makes it possible to perform normalization inside the heating chamber, it becomes unnecessary to remove the workpiece from the heating chamber in order to perform normalization. Therefore, there is no increase in the number of times the workpiece is moved, and dangers such as warping of the workpiece caused by moving it in a high temperature state can be avoided.

DETAILED DESCRIPTION OF THE INVENTION

Embodiments of a vacuum carburization processing apparatus and a vacuum carburization processing method according to the invention will be explained with reference to the drawings. In the followings drawings, dimensions of the various members are changed as appropriate to make them recognizable.

Figure 1A:
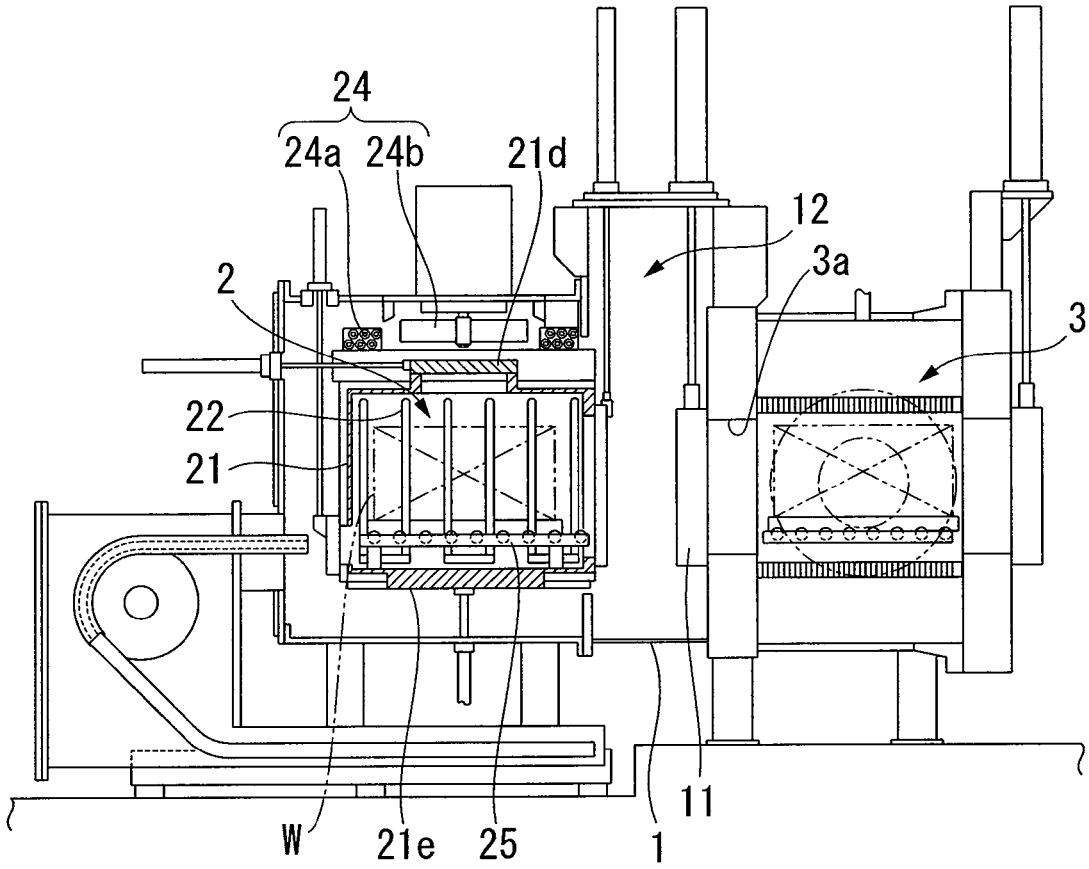
FIG. 1A is a frontal cross-sectional view of the configuration of a vacuum carburization apparatus in an embodiment of the invention.
Figure 1B:
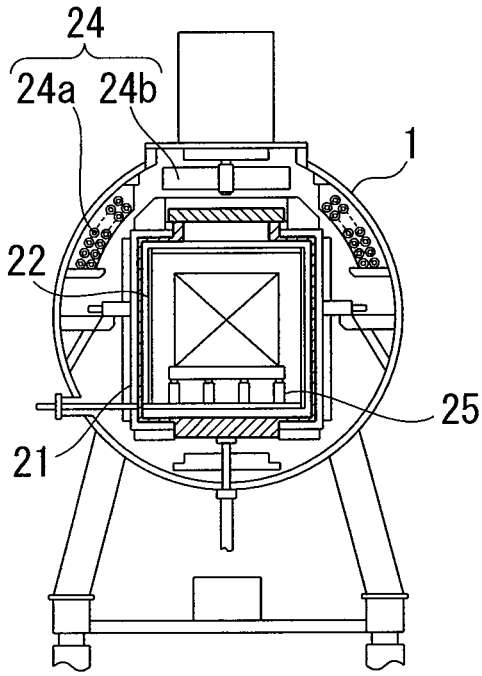
FIG. 1B is a left-side cross-sectional view of the configuration of a vacuum carburization apparatus in an embodiment of the invention.
Figure 1C:
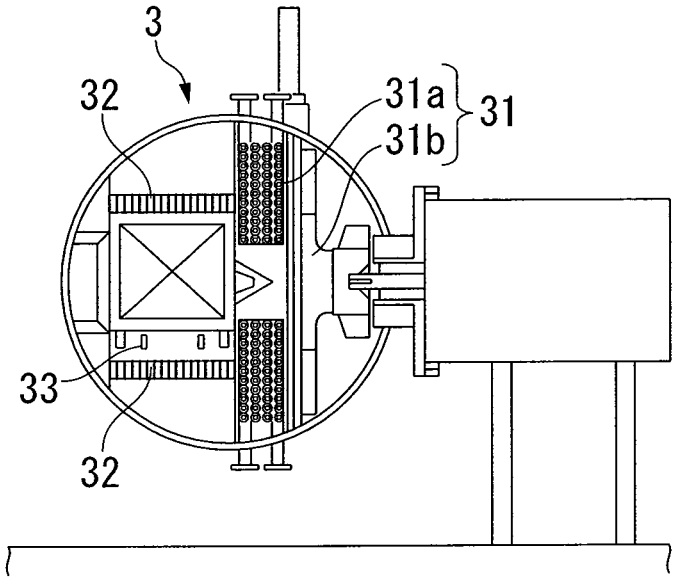
FIG. 1C is a right-side cross-sectional view of the configuration of a vacuum carburization apparatus in an embodiment of the invention.

FIGS. 1A to 1C are cross-sectional views of the configuration of a vacuum carburization processing apparatus according to the embodiment. FIG. 1A is a frontal cross-sectional view of the configuration of a vacuum carburization apparatus according to the embodiment, FIG. 1B is a left-side cross-sectional view, and FIG. 1C is a right-side cross-sectional view. As shown in FIGS. 1A to 1C, the vacuum carburization processing apparatus of the embodiment is a two-chamber type apparatus in which heating and cooling are performed in separate chambers, and includes a case 1, a heating chamber 2, and a cooling chamber 3. The case 1 is approximately cylindrical, and its axial line is arranged horizontally. The case 1 accommodates the heating chamber 2 in a partition on one side approximately at its center in the axial line direction, and accommodates the cooling chamber 3 on the other side. An opening-closing mechanism 12 opens and closes the cooling chamber 3 by raising and lowering a door 11 for closing an inlet 3*a* to the cooling chamber 3, and is provided approximately at a center portion in the axial line direction of the case 1.

Figure 2:
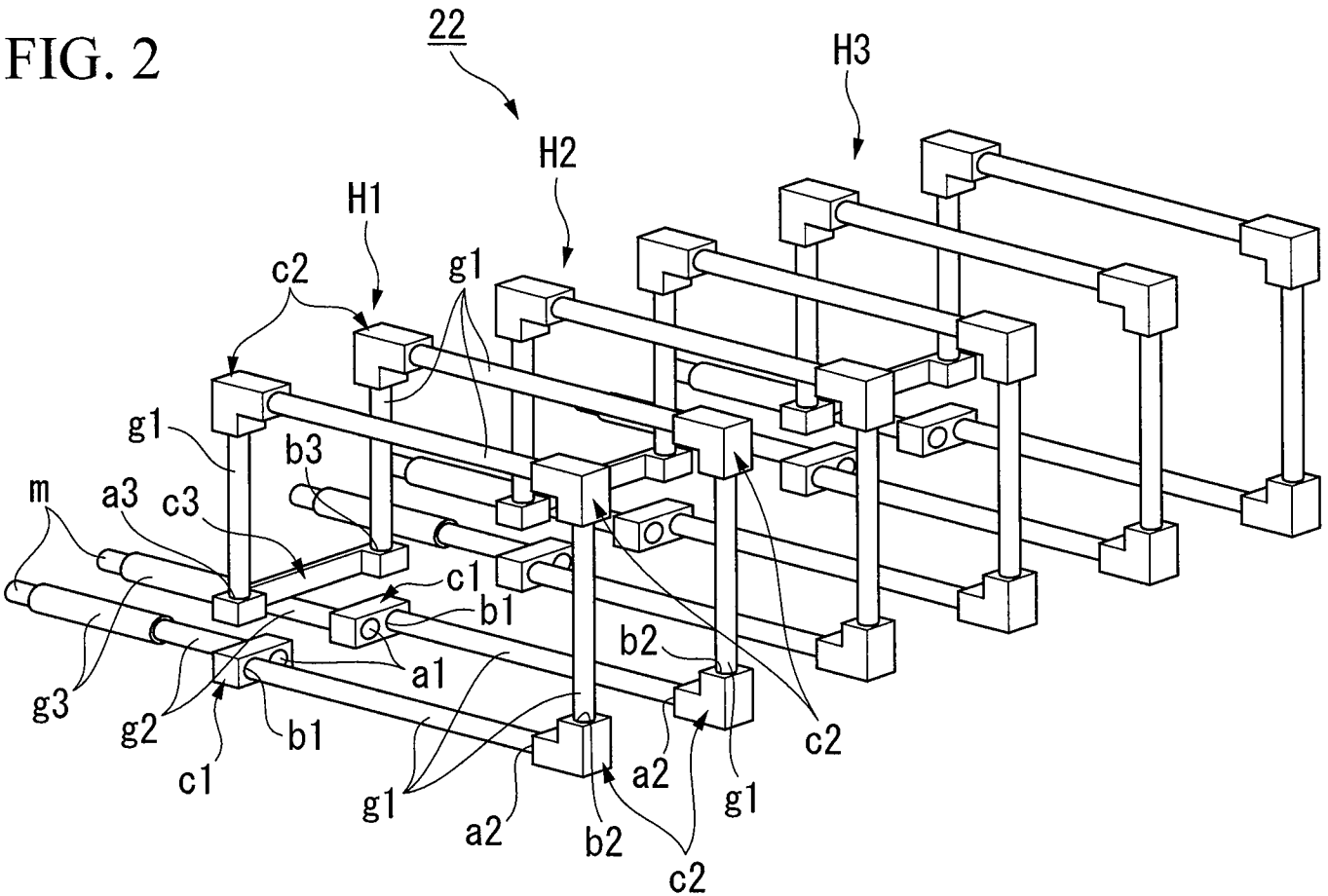
FIG. 2 is a perspective view of the shape of a heater in an embodiment of the invention.
Figure 3:
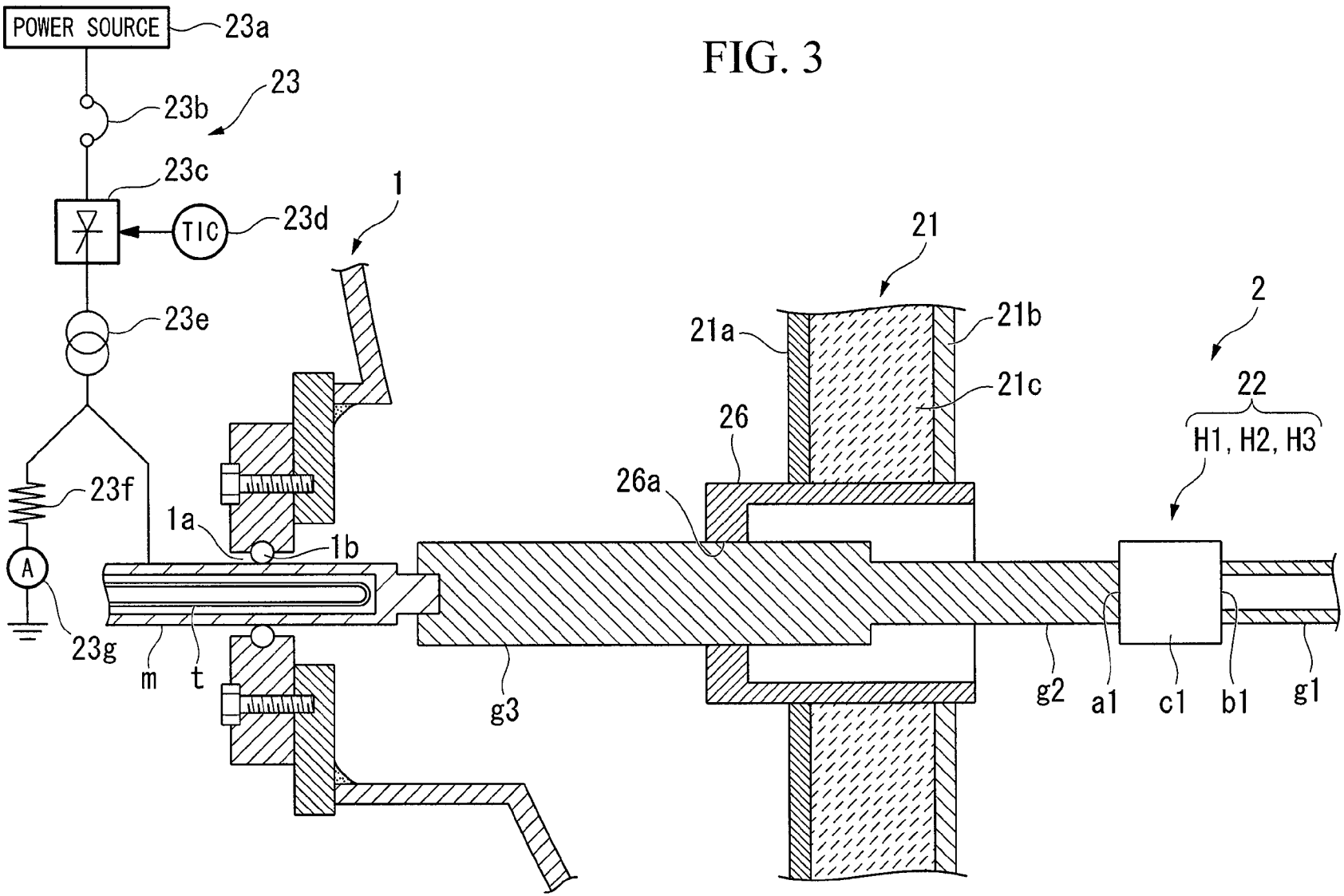
FIG. 3 is a schematic view of a structure for attaching a heater to a heat-insulating partition wall, and an electrical connection between the heater and a power unit, in an embodiment of the invention.

The heating chamber 2 includes a heat-insulating partition wall 21, a heater 22, a power unit 23, a cooler 24, and a pedestal 25. FIG. 2 is a perspective view of the shape of the heater 22. FIG. 3 is a schematic view of a structure for attaching the heater 22 to the heat-insulating partition wall 21, and an electrical connection between the heater 22 and the power unit 23.

As shown in FIG. 3, the heat-insulating partition wall 21 is formed by filling a space between a metal outer shell 21*a* and a graphite inner shell 21*b* with a heat-insulating material 21*c*. Also, as shown in FIG. 1, doors 21*d* and 21*e* are provided respectively on a top face and a bottom face of the heat-insulating partition wall 21.

As shown in FIG. 2, the heater 22 includes three identically-shaped heaters H1 to H3. Each heater includes a hollow thin part g1, a solid thin part g2, a solid thick part g3, connectors c1 to c3, and a feeding shaft m. The hollow thin part g1, the solid thin part g2, and the solid thick part g3 are made from graphite. The feeding shaft m is made of metal.

The connector c1 is rectangular, includes one each of connection parts a1 and b1 facing in opposite directions in each region bisected in the long direction, and conductively connects the hollow thin part g1 to the solid thin part g2. The connector c2 is L-shaped, includes two connection parts a2 and b2 that face in directions intersecting each other at right angles, and conductively connects the hollow thin parts g1. The connector c3 joins two connection parts a3 and b3 that face in a same direction with a space between them, and conductively connected the hollow thin parts g1.

Four hollow thin parts g1 are arranged so that they form a square, and three corners of this square are connected by the connectors c2. One end of each of the two hollow thin parts g1 that form the remaining corner of the square is connected by the connector c1 to the solid thin part g2, and the other end is attached to one of the connection parts a3 and b3 of the connector c3. An end of a side opposite to the end of the solid thin part g2 that is attached to the connector 1 connects to one end of the solid thick part g3, and the feeding shaft m is attached at another end of the solid thick part g3.

The configuration including the four hollow thin parts g1, the solid thin part g2, the solid thick part g3, the connector c1, the three connectors c2, and the feeding shaft m, forms a pair, which are connected by the connector c3 to constitute each of the heaters H1 to H3.

The heat-generating capabilities of the hollow thin part g1, the solid thin part g2, and the solid thick part g3 vary according to differences in their cross-sectional areas, descending in the order of the hollow thin part g1, the solid thin part g2, and the solid thick part g3, the solid thick part g3 being the least capable of generating heat.

As shown in FIG. 3, the feeding shaft m is hollow, and internally accommodates a cooling pipe t. Cooling water for suppressing increase in temperature caused by conduction circulates along this cooling pipe t.

The heaters H1 to H3 are supported by a heater supporter 26 provided in one section of the heat-insulating partition wall 21. The heater supporter 26 is formed from ceramics in an approximately cylindrical shape whose inner diameter is larger than the solid thick part g3, and is secured so that an axial direction of the cylinder is parallel to a thickness direction of the heat-insulating partition wall 21, and each end is positioned on an inner side and an outer side of the heat-insulating partition wall 21. The end positioned on the outer side of the heat-insulating partition wall 21 has an opening 26*a* whose diameter is the same as the diameter of the solid thick part g3 whose diameter is narrower than the inner diameter of the cylinder. Each of the heaters H1 to H3 is supported by fitting the solid thick part g3 into this opening 26*a*.

The feeding shaft m leads to the outside of the case 1 from an opening 1*a* formed on the case 1. A gap between the opening 1*a* and the feeding shaft m is sealed by blocking it with seal material 1*b*. The power unit 23 is connected to the feeding shaft m.

The power unit 23 includes a power source 23*a*, a breaker 23*b*, a thyristor 23*c*, a temperature controller 23*d*, a transformer 23*e*, a resistor 23*f*, and a current meter 23*g*.

The power source 23*a* connects via the breaker 23*b*, the thyristor 23*c*, and the transformer 23*e* to the feeding shaft m, and supplies electrical power to the feeding shaft m. The breaker 23*b* prevents circuit overload by cutting off the power when the load to the circuit exceeds a permitted range.

The thyristor 23*c* operates in conjunction with the temperature controller 23*d*, keeping the circuit in a conductive state until the temperature of the heaters H1 to H3 reaches a predetermined temperature, and canceling conduction when the temperature of the heaters H1 to H3 reaches the predetermined temperature. The transformer 23*e* converts the voltage of the power supply from the power source 23*a* to a predetermined value.

The resistor 23*f* and the current meter 23*g* are installed midway along a grounded circuit that splits from between the transformer 23*e* and the feeding shaft m. The current meter 23*g* measures the earth fault current.

The cooler 24 is provided above the heat-insulating partition wall 21, and includes a heat exchanger 24*a* and a fan 24*b*. The heat exchanger 24*a* removes heat from air heated in the heating chamber 2. The fan 24*b* circulates air inside the heating chamber 2 and the case 1.

To cool the inside of the heating chamber 2, the doors 21*d* and 21*e* of the heat-insulating partition wall 21 are opened, and the heating chamber 2 is cooled by the heat exchanger 24*a* while the fan 24*b* circulates air inside the heating chamber 2 and the case 1, thereby lowering the temperature in the heating chamber 2 and the temperature of a workpiece W inside the heating chamber 2.

The pedestal 25 is constituted by a rectangular frame and a plurality of rollers, the rollers being arranged with their rotating axes in parallel rows on two opposing sides of the frame, and are supported so that their ends can freely rotate on two other sides of the frame. The pedestal 25 is disposed so that the rotating axes of the rollers intersect the transportation direction at right angles; this improves delivery of the workpiece W. The workpiece W is mounted on the pedestal 25, and uniformly heated from beneath its bottom face.

Since materials of increasingly low vapor pressure vaporize at increasingly high temperatures in a vacuum, every member that is exposed to the temperature inside the heating chamber 2 is made from a material that will not vaporize even if the temperature inside the heating chamber 2 increases to approximately 1300° C.

The cooling chamber 3 cools the workpiece W, and includes a cooler 31, a flow-adjusting plate 32, and a pedestal 33.

The cooler 31 has a heat exchanger 31*a* and a fan 31*b*. The heat exchanger 31*a* removes heat from air inside the cooling chamber 3. The fan 31*b* circulates high pressure air inside the cooling chamber 3.

The flow-adjusting plate 32 is formed by combining a grid box partitioned into a grid pattern with a punching metal. The flow-adjusting plate 32 is disposed above and below the position where the workpiece W is mounted inside the cooling chamber 3, and adjusts the flow direction of gas in the cooling chamber 3. The pedestal 33 has approximately the same structure as the pedestal 25 inside the heating chamber 2, and is arranged at the same height as the pedestal 25.

Subsequently, a vacuum carburization process performed by the vacuum carburization processing apparatus described above will be explained based on FIGS. 4 to 7. In this vacuum carburization process, a preparatory heating step, pre-carburization maintaining step, a carburizing step, a diffusing step, a normalizing step, a reheating step, a pre-quench maintaining step, and a quenching step are performed in that sequence.

Figure 4:
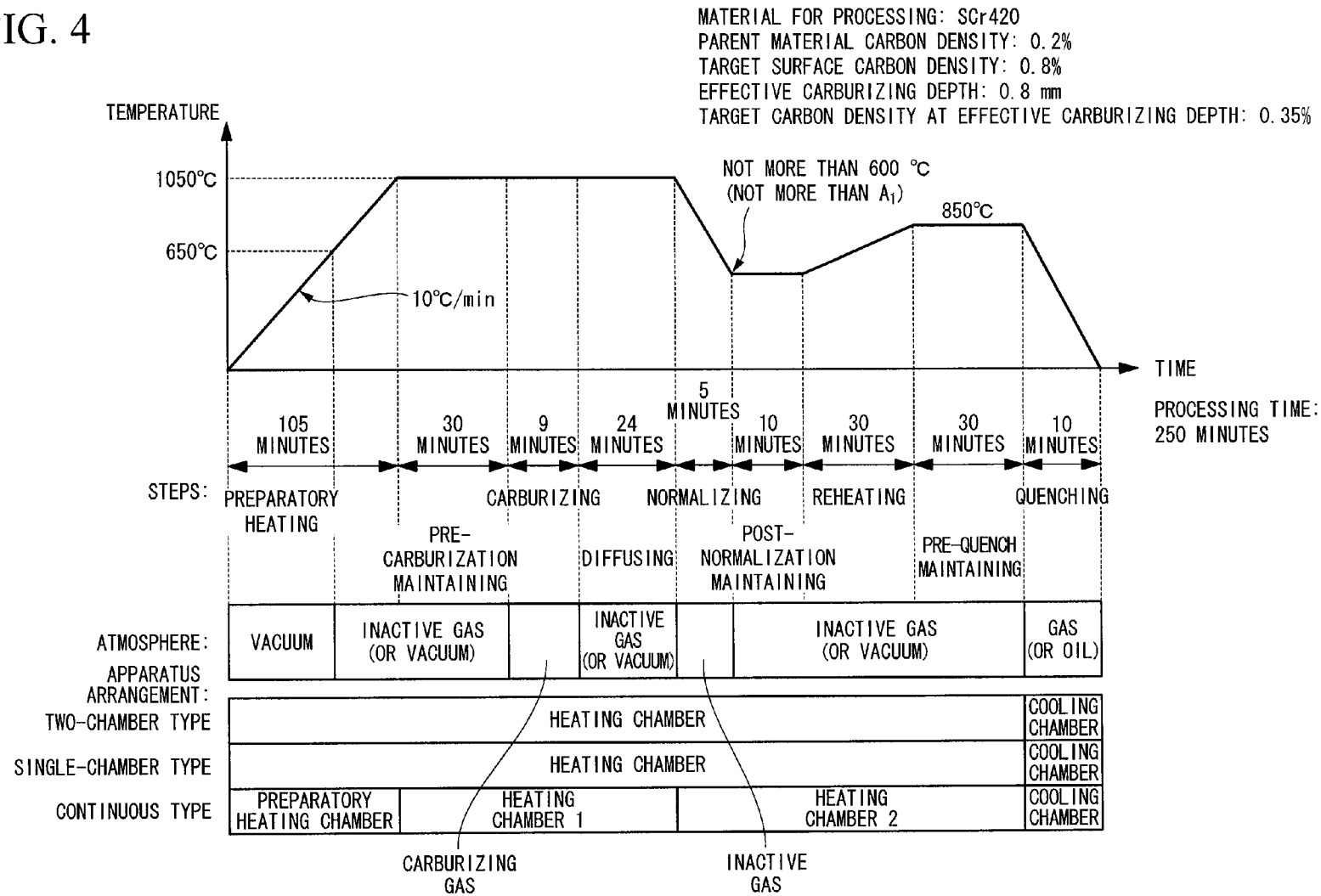
FIG. 4 is an explanatory view of processing times, temperatures, atmospheric conditions, and examples of apparatus arrangements, in each step of a vacuum carburization process in an embodiment of the invention.
Figure 5:
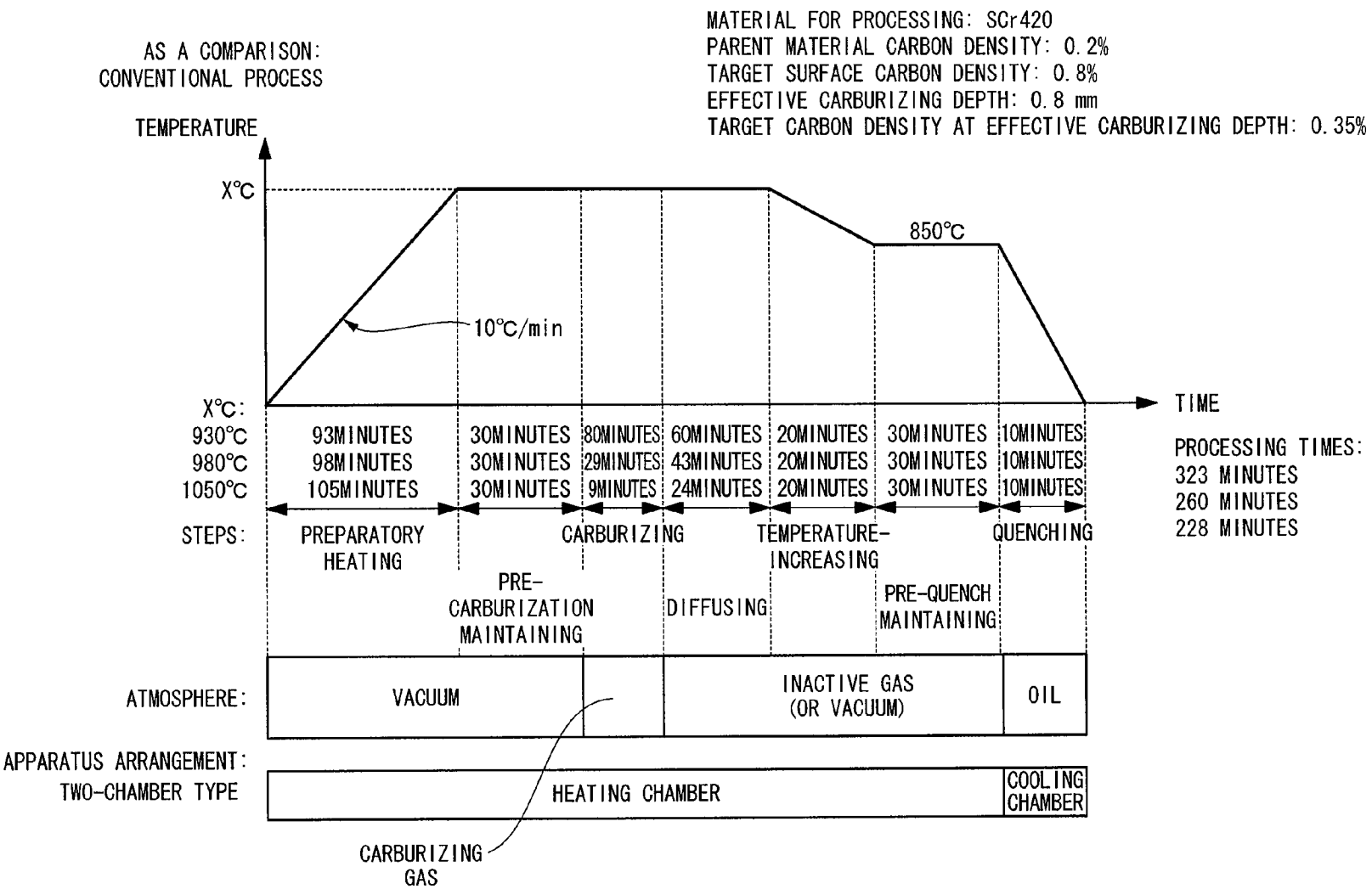
FIG. 5 is an explanatory view of processing times, temperatures, atmospheric conditions, and examples of apparatus arrangements, in each step of a conventional vacuum carburization process by way of comparison with FIG. 4.

FIG. 4 is an explanatory view of processing times, temperatures, atmospheric conditions, and examples of apparatus arrangements, in each step when SCr420 carburized steel having a parent material carbon density of 0.2% is used as a material for processing, the target surface carbon density is 0.8%, the effective carburizing depth is 0.8 mm, and the target carbon density at the effective carburizing depth is 0.35%. By way of comparison, FIG. 5 is an explanatory view of temperatures, atmospheric conditions, and examples of apparatus arrangements, in each step of a conventional vacuum carburization process.

The processing times of the steps in these explanatory diagrams are calculated by a diffusion equation using Fick's second law.

In a preparatory heating step, the workpiece W is mounted at a position in the heating chamber 2 where it is surrounded by the heaters H1 to H3. Pressure in the heating chamber 2 is then reduced by evacuation of air to achieve a vacuum. While in conventional vacuum carburization processes, 'vacuum' signifies a pressure equal to or less than approximately 10 kPa, which is approximately one-tenth of atmospheric pressure, in this embodiment 'vacuum' signifies a pressure equal to or less than 1 Pa.

The temperature inside the heating chamber 2 is increased by supplying a current to the heater 22. While the vacuum carburization process can be performed by executing the entire preparatory heating step in a vacuum, in this embodiment, to prevent vaporization of material from the surface of the workpiece W, an inactive gas is introduced into the heating chamber 2 when the temperature in the heating chamber 2 is increased to 650° C. The pressure in the heating chamber 2 at this time is approximately lower than atmospheric pressure and not less than 0.1 kPa. The temperature in the heating chamber 2 is further increased, and, when it reaches 1050° C., the process shifts to the pre-carburization maintaining step.

In a pre-carburization maintaining step, the temperature in the heating chamber 2 is maintained at the final temperature of the preparatory heating step. The pre-carburization maintaining step ensures that the workpiece W has a uniform temperature of 1050° C. from its surface to its internal part. During the last two minutes of the pre-carburization maintaining step, the pressure inside the heating chamber 2 is lowered and returned to a vacuum state by discharging the inactive gas.

In a carburizing step, a carburizing gas (e.g. acetylene gas) is supplied into the heating chamber 2. For example, the carburizing gas is acetylene gas. The pressure in the heating chamber 2 is now equal to or less than 0.1 kPa. In the carburizing step, the workpiece W is carburized by placing it in the carburizing gas atmosphere at the temperature of 1050° C. inside the heating chamber 2.

In a diffusing step, the carburizing gas is discharged from the heating chamber 2, and an inactive gas in introduced. The pressure in the heating chamber 2 at this time is approximately lower than atmospheric pressure and not less than 0.1 kPa. The temperature in the heating chamber 2 is then maintained. This diffusing step diffuses carbon from near the surface of the workpiece W into its internal part.

If temperature conditions are the same in the carburizing step and the diffusing step, the processing times of these steps are determined by the surface carbon density, the effective carburizing depth, and the carbon density at the effective carburizing depth.

After the diffusing step, a normalizing step and a post-normalization maintaining step are performed. Since the workpiece W is maintained at a temperature of 1050° C. for a long time prior to the normalizing step, its crystal grains become enlarged.

In the normalizing step, the temperature inside the heating chamber 2 is reduced by using the cooler 24. During the normalizing step, the temperature is reduced to equal to or lower than 600° C. over a predetermined processing time (five minutes in this embodiment). Then, in the post-normalization maintaining step, the temperature of the entire workpiece W is made uniform by maintaining the temperature for a predetermined time, thereby miniaturizing the enlarged crystal grains.

In a reheating step, the temperature in the heating chamber 2 that was reduced during the normalizing step is increased again. In the reheating step, the temperature is increased to 850° C., which is the quenching temperature for a quenching step performed later. This temperature is then maintained for a predetermined time in a pre-quench maintaining step to ensure that the workpiece W has a uniform temperature of 850° C. from its surface to its internal part.

Lastly, the workpiece W is transferred to the cooling chamber 3, where a quenching step is performed. In the quenching step, the cooler 31 cools the workpiece W. A material that does not quench easily, such as the material processed in this embodiment, namely SCr420 steel, must be cooled to approximately half of the temperature difference achieved by cooling within approximately the first minute of processing time. The cooler 31 increases the cooling speed by cooling the workpiece W while circulating air at high pressure (e.g. approximately ten to thirty times atmospheric pressure) inside the cooling chamber 3

As shown in FIG. 5, conventional vacuum carburization processes are generally performed at a processing temperature X° C. of 930° C. Since the vacuum carburization process of this embodiment is performed at 1050° C., carburization and diffusion are more rapid, making the processing time shorter than that of a conventional vacuum carburization process performed at 930° C.

The vacuum carburization process shown in FIG. 5 does not include a normalizing step; the diffusing step is followed by a temperature reducing step, in which the temperature is reduced to the quenching temperature, before shifting to the pre-quench maintaining step. In conventional vacuum carburization processes such as this, the processing time is shortened by increasing the processing temperature. However, since the crystal grains of the workpiece W, which become enlarged as a result of processing at high temperature, cannot be miniaturized, it is impossible to obtain a workpiece W having predetermined physical values.

In contrast with the conventional vacuum carburization process described above, according to the vacuum carburization process of the embodiment, even if the crystal grains become enlarged during carburization and diffusion at high temperature in order to reduce processing time, the crystal grains can be miniaturized by normalization. This makes it possible to reduce processing time by processing at high temperature, while solving the problem of crystal grain enlargement caused by processing at high temperature, and thereby obtain a workpiece W having predetermined physical values. Moreover according to this embodiment, since reheating and quenching are performed after normalizing, the vacuum carburization process can be completed efficiently.

According to a vacuum carburization processing apparatus of the embodiment, since the heating chamber 2 includes the cooler 24, normalization can be performed easily after diffusion. Furthermore, since the heating chamber 2 includes the cooler 24, normalization can be performed inside the heating chamber 2. Since this renders it unnecessary to remove the workpiece W from the heating chamber 2 for normalizing, there is no increase in the number of times the workpiece W is moved, whereby dangers such as warping caused by moving the workpiece W at high temperature can be avoided.

Figure 6:
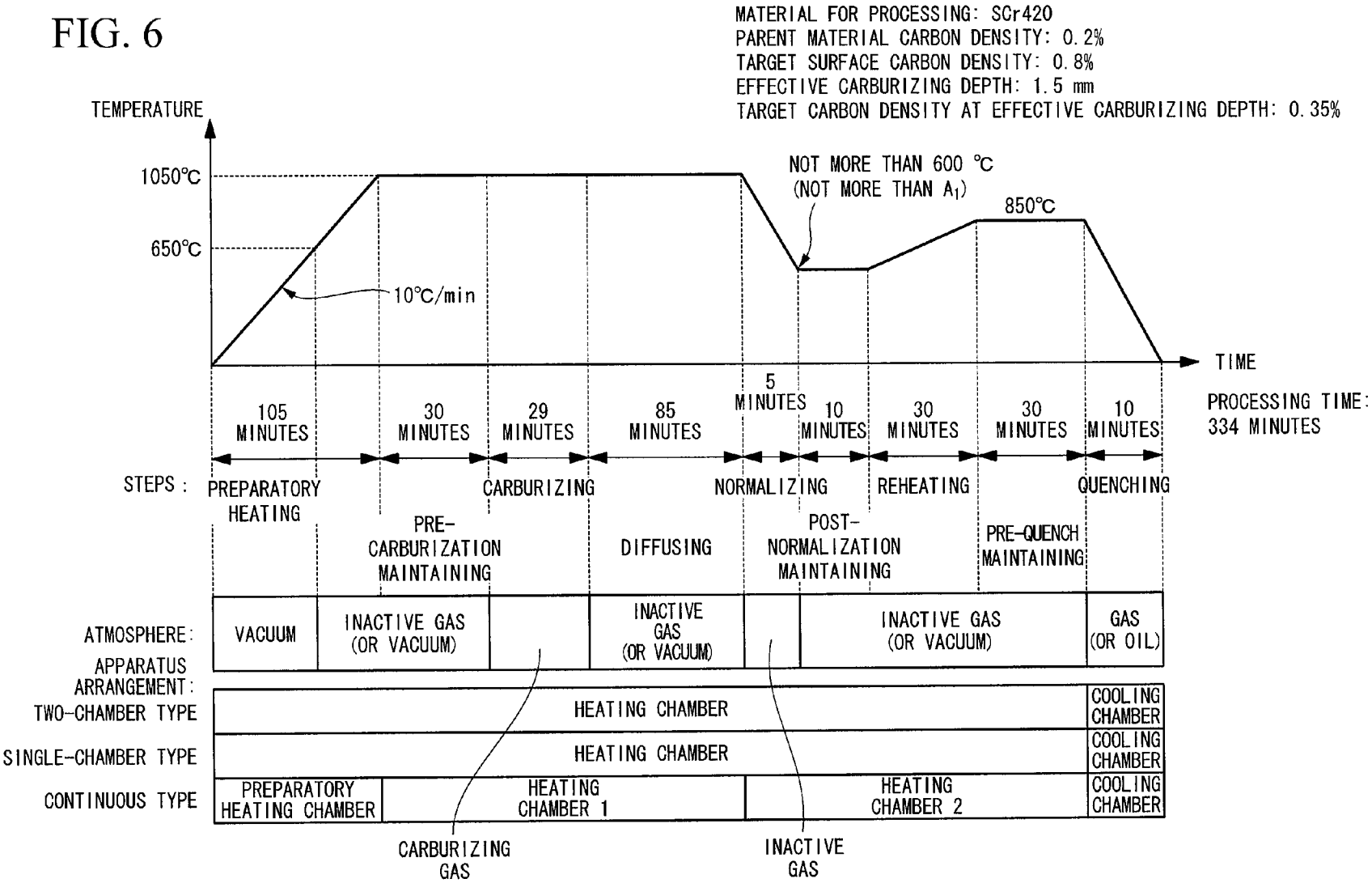
FIG. 6 is an explanatory view of processing times, temperatures, atmospheric conditions, and examples of apparatus arrangements, in each step of a vacuum carburization process in an embodiment of the invention (the effective carburizing depth being different from FIG. 4.

FIG. 6 is an explanatory view of processing times, temperatures, atmospheric conditions, and examples of an apparatus arrangement, in each step when SCr420 carburized steel having a parent material carbon density of 0.2% is used as a material for processing, the target surface carbon density is 0.8%, the effective carburizing depth is 1.5 mm, and the target carbon density at the effective carburizing depth is 0.35%. That is, the vacuum carburization process shown in FIG. 6 uses, as the material for processing, the same steel as that used in the vacuum carburization process of FIG. 4, and differs from the process of FIG. 4 only in that the effective carburizing depth is 1.5 mm. By way of comparison, FIG. 7 is an explanatory view of temperatures, atmospheric conditions, and examples of apparatus arrangements, in each step of a conventional vacuum carburization process.

Figure 7:
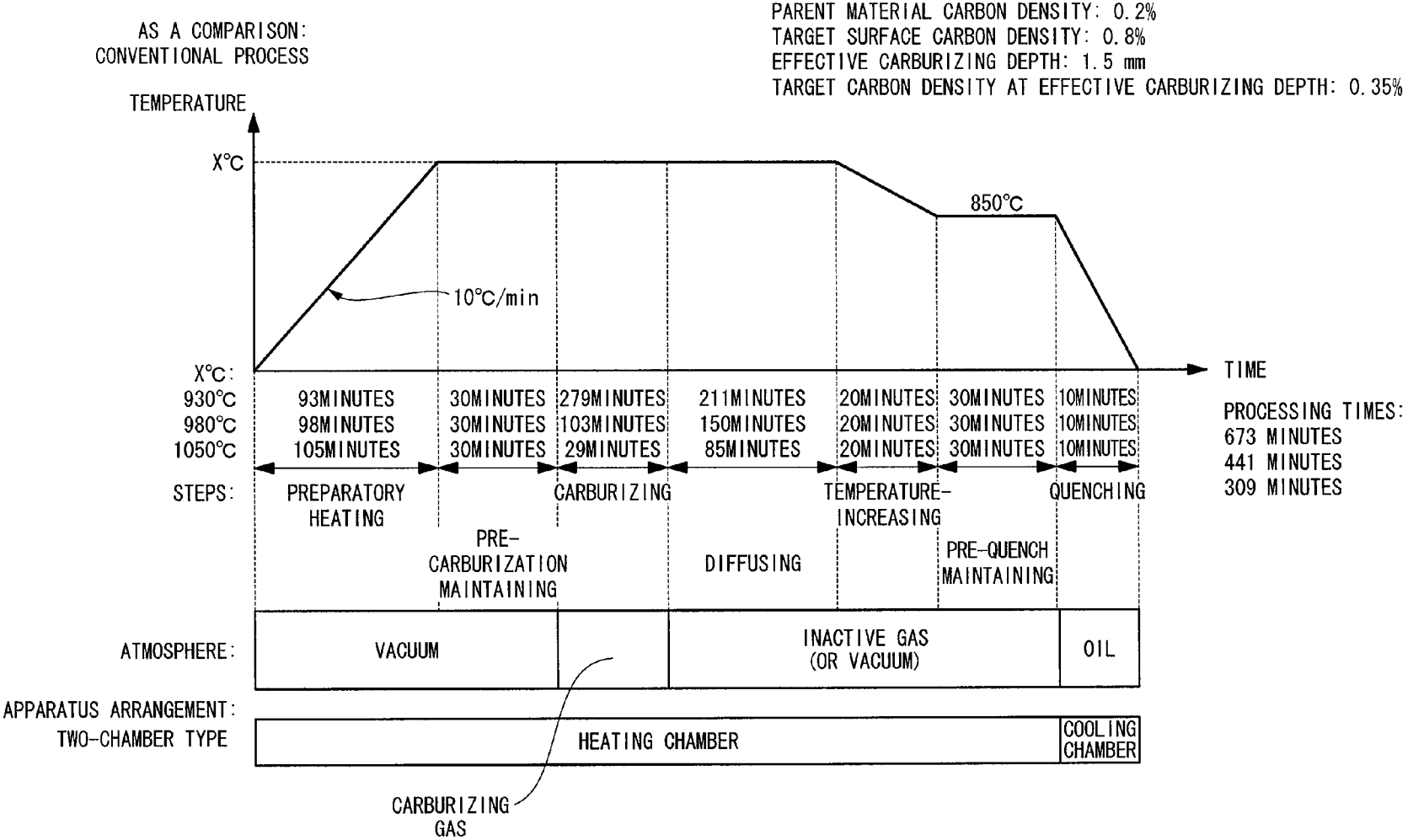
FIG. 7 is an explanatory view of processing times, temperatures, atmospheric conditions, and examples of apparatus arrangements, in each step of a conventional vacuum carburization process by way of comparison with FIG. 6.

As in FIGS. 4 and 5, the processing times of the steps in the explanatory diagrams of FIGS. 6 and 7 are calculated by a diffusion equation using Fick's second law.

Since the effective carburizing depth in the vacuum carburization process of FIG. 6 is deeper than that in the vacuum carburization process of FIG. 4, the processing times for the carburizing step and the diffusing step are longer. The other processing times in FIG. 6 are the same as those in FIG. 4. Likewise, in the conventional vacuum carburization process shown in FIG. 7, since the effective carburizing depth is deeper than that in the conventional vacuum carburization process of FIG. 5, the processing times for the carburizing step and the diffusing step are longer. The other processing times in FIG. 7 are the same as those in FIG. 5.

As can be seen from a comparison of FIGS. 6 and 7, in the vacuum carburization process with the deeper effective carburizing depth, processing times for the carburizing step and the diffusing step are longer can be made shorter than in the conventional vacuum carburization process. Furthermore, in the vacuum carburization process with the deeper effective carburizing depth, even if the crystal grains become enlarged as a result of performing carburization and diffusion at high temperature in order to shorten the processing times, the crystal grains can be miniaturized by normalization. Therefore, the processing times can be shortened by high-temperature processing while solving the problem of crystal grain enlargement resulting from the high-temperature processing, whereby a workpiece W having predetermined physical values can be obtained.

Subsequently, a degassing step will be explained. In this embodiment, a degassing step is performed when an earth fault occurs in the heating chamber 2. In the degassing step, when the value of an earth fault current measured by the current meter 23*g* exceeds a predetermined threshold, the temperature in the heating chamber 2 is increased to between 50° C. and 150° C. higher than the processing temperature (1050° C. in this embodiment) without introducing the workpiece W into the heating chamber 2. After maintaining this temperature for a predetermined time, cooling is performed. This degassing step causes soot inside the heating chamber 2 to evaporate.

Although the temperature of the heating chamber 2 increases to approximately 1200° C. during the degassing step, the soot can be removed without damaging the constituent parts of the heating chamber 2, since they are made from material that does not vaporize even if the temperature increases to approximately 1300° C.

To implement the degassing step, the structure of the heater 22 is modified from a conventional structure. In conventional heaters, the heat-generating section (i.e. the conductive section) is covered with an insulator such as ceramics to prevent problems caused by soot sticking to it, heat being transmitted to the outside indirectly via this insulator.

However, when performing the normalizing step of this embodiment in the heating chamber 2, if the conventional structure mentioned above is used, the ceramics of the insulator covering the conductive section breaks due to being abruptly cooled from a heated state. For this reason, the heating chamber 2 of this embodiment has a below-described structure.

The heating chamber 2 of this embodiment has a structure that can withstand abrupt cooling from a heated state. In the heating chamber 2 having the structure of the embodiment shown in FIG. 3, an earth fault occurs when the heater supporter 26 is covered with soot. In contrast in this embodiment, the earth fault current is monitored, and damage resulting from earth faults is prevented by performing the degassing step when the earth fault current exceeds a predetermined threshold, and recovering it from the earth fault state.

While the explanation of this embodiment uses the two-chamber vacuum carburization processing apparatus shown in FIG. 1, a vacuum carburization process in which a normalizing step and a reheating step are performed after a diffusing step, such as in the embodiment described above, can also be used in other types of vacuum carburization processing apparatus.

Figure 8:
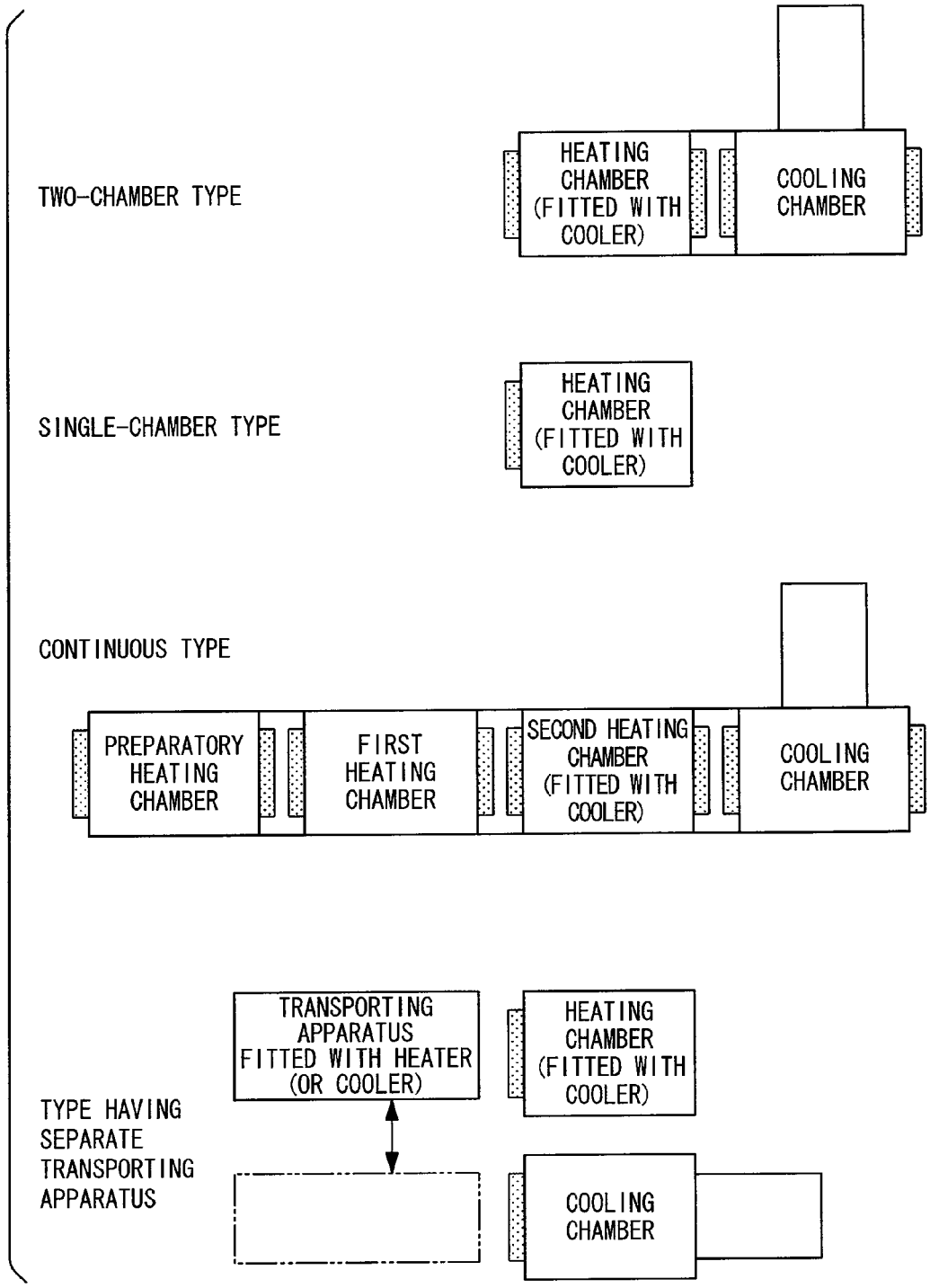
FIG. 8 is a schematic view of examples of arrangements of vacuum carburization processing apparatuses in an embodiment of the invention.

FIG. 8 is a schematic view of examples of arrangements of vacuum carburization processing apparatuses. As shown in FIG. 8, in addition to the two-chamber type described above, the arrangements of these vacuum carburization processing apparatuses include a single-chamber type, a continuous type, a type having a separate transporting apparatus, etc.

The single-chamber type has no special cooling chamber and includes only a heating chamber, a cooler being incorporated inside the heating chamber. Since the cooler is inside the heating chamber, the single-chamber type has a slow temperature-reduction speed, and can therefore be used when the workpiece is made of a steel that normalizes easily. Since the workpiece in this embodiment is SCr420 steel that does not normalize easily, the normalizing step cannot be performed using the single-chamber type.

The continuous type is an arrangement used when continuously performing vacuum carburization processes to a great many workpieces W, and includes a preparatory heating chamber, a first heating chamber, a second heating chamber, and a cooling chamber. A cooler is provided in the second heating chamber. The continuous type performs the vacuum carburization process in a sequence of, for example, performing a preparatory heating step in the preparatory heating chamber, performing a pre-carburization maintaining step, a carburizing step, and a diffusing step in the first heating chamber, performing a normalizing step, a reheating step, and a pre-quench maintaining step in the second heating chamber, and performing a quenching step in the cooling chamber. Since each workpiece W is moved sequentially between the processing chamber as the steps of the vacuum carburization process proceed, a great many workpieces W can be processed one after another.

In the type having a separate transporting apparatus, instead of arranging the heating chamber 2 and the cooling chamber 3 of the embodiment inside the same case 1, they are arranged as separate processing chambers, and a transporting apparatus transports the workpiece W between them. As in the embodiment described above, the steps of the vacuum carburization process from the preparatory heating step to the pre-quench maintaining step are performed in the heating chamber, and the quenching step is performed in the cooling chamber.

A plurality of heating chambers, not only one heating chamber, can be provided. During the vacuum carburization process, the time required by the heating chamber is longer than the time required by the cooling chamber. Consequently, if one heating chamber and one cooling chamber are provided, the vacant empty time of the cooling chamber will increase, whereas if the number of heating chambers is increased in accordance with the number of workpieces, and the workpieces are transported in sequence from a plurality of heating chambers to the cooling chamber, the vacant time of the cooling chamber can be reduced. The cooling chamber can thereby be used more effectively, and the vacuum carburization process can be performed efficiently. Incidentally, when a plurality of heating chambers are provided, at least one of them can be fitted with a cooler, and the other heating chambers may not have the coolers.

In addition to the example shown in FIG. 8, another conceivable example of a type having a separate transporting apparatus is one that includes a main receptacle and an antechamber. The main receptacle is, for example, an airtight cylinder. One or a plurality of heating chambers, a cooling chamber, and an antechamber are connected in radial formation on the outer peripheral face of the cylindrical main receptacle, and a transporting apparatus is accommodated inside it. The transporting apparatus rotates inside the main receptacle between positions where any of the heating chambers, the cooling chamber, and the antechamber are connected.

In this type of vacuum carburization processing apparatus, when a user places a workpiece in the antechamber, the transporting apparatus transports the workpiece from the antechamber to the heating chamber, from the heating chamber to the cooling chamber, and from the cooling chamber to the antechamber. The user then retrieves the workpiece from the antechamber.

According to this vacuum carburization processing apparatus, since the workpiece always passes through the main receptacle when being transported between chambers, the vacuum carburization process can be performed without exposing the workpiece to the outside atmosphere between placing it in the antechamber and retrieving it from the antechamber. Since one workpiece can be placed in/retrieved from the antechamber while another workpiece is in the heating chamber or the cooling chamber, when performing the vacuum carburization process to a plurality of workpieces, each chamber can be used effectively.

Incidentally, the shape of the receptacle described above is merely an example, it being necessary only that the receptacle can accommodate the transporting apparatus and connect the heating chambers, the cooling chamber, and the antechamber.

By fitting a heater and/or a cooler to the transporting apparatus, the temperature of the workpiece can be maintained while transporting it between the heating chamber and the cooling chamber. Moreover, when connecting the heating chamber or the cooling chamber to the transporting apparatus in order to transfer the workpiece, the temperature inside the heating chamber (or the temperature inside the cooling chamber) can be approximately matched with the temperature inside the transporting apparatus by using the heater (or the cooler) of the transporting apparatus. The cooler of the transporting apparatus can then be used to cool the workpiece to normal temperature after the vacuum carburization process.

Figure 9:
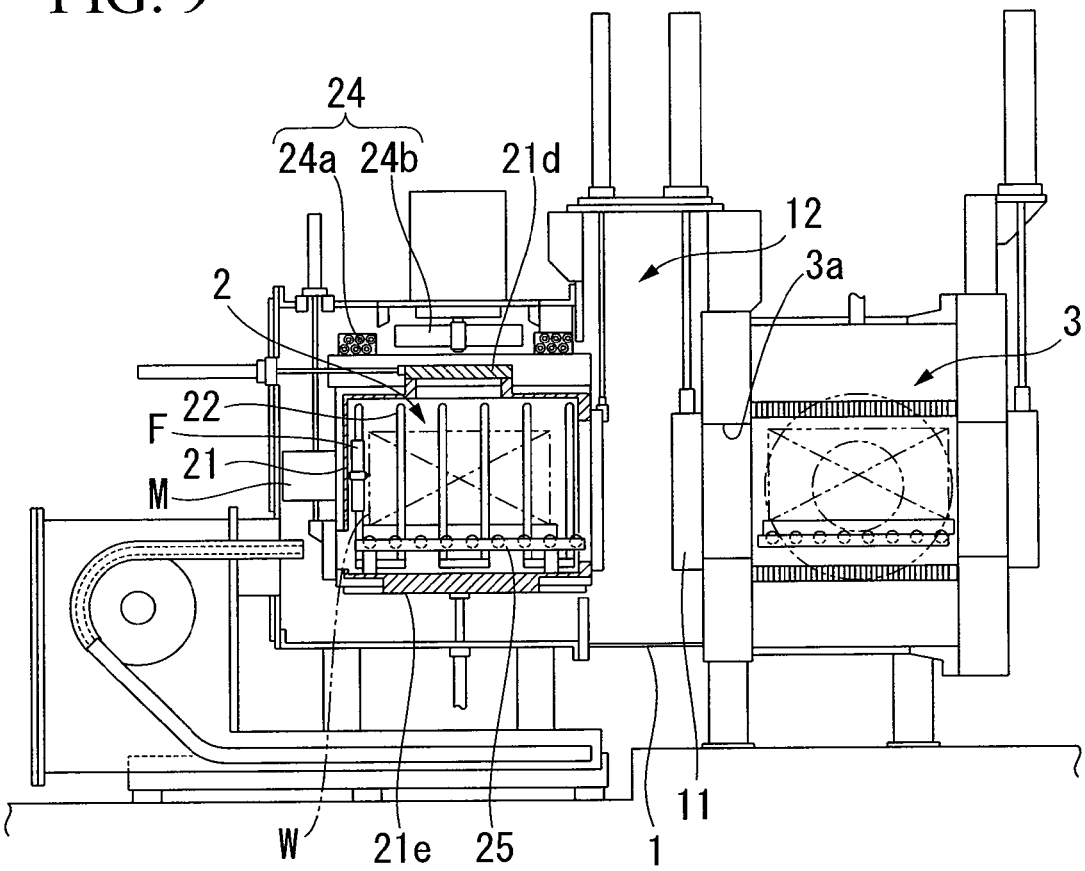
FIG. 9 is a cross-sectional view of the configuration of a vacuum carburization processing apparatus in another embodiment of the invention.

As shown in FIG. 9, a fan for convection heating F, and a motor M that rotates a fan F for convection heating, can be additionally provided as constituent elements of the heater 22. The fan for convection heating F and the motor M constitute a gas convection apparatus.

In this configuration, when increasing the temperature from low to high as in, for example, the preparatory heating step, an inactive gas is supplied into the heating chamber 2, the workpiece W is placed in an inactive atmosphere, and heat is generated by supplying current to the heaters H1 to H3 while using the motor M to rotate the fan F for convection heating, whereby the temperature of the workpiece W can be increased speedily and uniformly.

While in the embodiment described above, the cooler 31 cools the workpiece W by circulating high-pressure air, the cooler can use oil to cool the workpiece W.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A vacuum carburization processing method comprising:

a preparatory heating step of increasing a temperature of a workpiece in a heating chamber to a first temperature;

a carburizing step of carburizing the workpiece by supplying carburizing gas into the heating chamber from a state where the pressure inside the heating chamber is less than or equal to 0.1 kPa;

a diffusing step of terminating the supply of the carburizing gas and making carbon diffuse from a surface of the workpiece into its internal part;

a quenching step of abruptly cooling the temperature of the workpiece from a state where the temperature of the workpiece is at a second temperature;

a pre-carburization maintaining step, performed between the preparatory heating step and the carburizing step, of maintaining the workpiece at a final temperature of the preparatory heating step, wherein pressure inside the heating chamber is reduced to less than or equal to 1 Pa in the last two minutes of the pre-carburization maintaining step;

a normalizing step, performed between the diffusing step and the quenching step, of reducing the temperature of the workpiece so that a temperature history of the workpiece from the first temperature to a predetermined temperature satisfies predetermined conditions;

a post-normalization maintaining step, performed after the normalizing step, of miniaturizing crystal grains of the workpiece by maintaining the workpiece at the predetermined temperature for a predetermined time so that the entire workpiece reaches the predetermined temperature; and a reheating step, performed after the post-normalization maintaining step, of increasing the temperature of the workpiece to the second temperature.

2. The vacuum carburization processing method according to claim 1, wherein the carburizing step, the diffusing step, the normalizing step, and the reheating step are performed inside the heating chamber.

3. The vacuum carburization processing method according to claim 1, wherein the quenching step is performed in a cooling chamber provided separately from the heating chamber, and the cooling chamber is configured to cool the workpiece.

4. The vacuum carburization processing method according to claim 1, wherein the preparatory heating step, the diffusing step, and the reheating step are performed in a state in which the pressure inside the heating chamber is reduced to less than or equal to 0.1 kPa, or in a state in which an inactive gas is introduced into the heating chamber.

* * * * *